US006105294A

United States Patent [19]

Goodfellow

[11] Patent Number: 6,105,294

[45] Date of Patent: Aug. 22, 2000

[54] CARD CARRYING CASE

[76] Inventor: David Goodfellow, P.O. Box 3031, Sioux Lookout, Ontario, Canada, P8T 1J8

[21] Appl. No.: 09/251,463

[22] Filed: Feb. 17, 1999

[51] Int. Cl.[7] ..... G09F 3/20

[52] U.S. Cl. ..... 40/654.01; 40/1.6; 40/649; 206/39.5

[58] Field of Search ..... 40/654.9, 666, 40/649, 1.6

[56] References Cited

U.S. PATENT DOCUMENTS

| | | | |
|---|---|---|---|
| 4,790,435 | 12/1988 | Trusty | 206/39.5 |
| 5,592,767 | 1/1997 | Treske | 40/649 |
| 5,613,602 | 3/1997 | Lage et al. | 40/666 |

*Primary Examiner*—Cassandra H. Davis
*Attorney, Agent, or Firm*—Murray E. Thrift; Adrian D. Battison

[57] ABSTRACT

A card carrying case includes a U-shaped housing and an insert for insertion therein. The housing has a bottom member and two side members wherein each member includes an edge portion and a flange extending inward along a front face of the case for retaining the cards within the housing. A support member extends across a rear face of the housing from one side member to the other for retaining the cards. A plurality of cylindrical protrusions mount on the support member for co-operating with a plurality of apertures in the insert and for retaining the insert within the housing. The insert includes a pair of leaf springs extending from the support member towards the bottom member for urging the cards to engage the flanges of the bottom and two sides. The insert also includes a pair of fingers extending from the support member towards a top end of the housing. Each finger includes an upright portion and an inclined portion extending from the straight portion towards the front face of the housing for restricting the removal of the cards from the top end of the housing. A belt clip is extends rearward from the insert for mounting the case on a belt or other similar structure.

5 Claims, 4 Drawing Sheets

CARD CARRYING CASE

FIELD OF THE INVENTION

This invention relates to a card carrying case and more particularly to a card carrying case that may be used for displaying cards and dispensing the cards one at a time.

BACKGROUND

Cards containing information for contacting business associates and personal acquaintances are often carried for conveniently recollecting or distributing this information. A variety of card carrying cases have been designed for carrying and dispensing business type cards.

The prior art generally includes a housing, a card opening in the housing for dispensing a card and a finger opening for gripping a card to urge it towards the card opening. The finger opening varies from one design to another and is most of often quite small. This does not display the cards but merely aids in dispensing the cards. The card openings are often used exclusively for dispensing while loading the case requires opening up the housing to gain access to the interior. This is an inconvenient procedure.

SUMMARY

According to the present invention there is provided a card carrying case comprising:

a U-shaped housing including a bottom member having an edge portion and a flange extending upward from the edge portion along a front face of the case for retaining the cards within the housing, and two side members wherein each side member has an edge portion and a flange extending inwards from the edge portion along the front face the case for retaining the cards within the housing;

a support member extending across a rear face of the housing from one side member to the other side member for retaining the cards wherein the support member, the bottom member and the two side members define a rear opening for inserting the cards into the case;

at least one leaf spring extending from the support member towards the bottom member of the housing for urging the cards to engage the flanges of the bottom and two sides; and at least one finger extending from the support member towards a top end of the housing;

wherein each finger includes an upright portion and an inclined portion extending from the upright portion towards the front face of the housing for restricting the removal of the cards from the top end of the housing.

It is preferred that the card carrying case includes a mounting clip on the support member. The clip may be used for supporting the case on a belt or a vehicle sunvisor. A mounting bracket on the support member may be used to mount the case on a fixed table or wall.

It is also preferred that the card carrying case includes a main housing and an insert fastened within the main housing. The main housing includes the bottom member, the two side members, the support member and a plurality of cylindrical protrusions mounted on the support member. The insert includes the leaf spring or springs, the finger or fingers, and a plurality of apertures in the insert for cooperating with the protrusions for fastening the insert to the housing.

When mounting the insert into the main housing it is preferred that the protrusions comprise a raised cylindrical portion having a bore extending therethrough such that insertion of a tool into the bore will expand the raised cylindrical portion such that the cylindrical protrusion engages the aperture for further securing the insert on the main housing.

BRIEF DESCRIPTION OF THE DRAWINGS

In the accompanying drawings, which illustrate an exemplary embodiment of the present invention.

DETAILED DESCRIPTION

Figure 1:
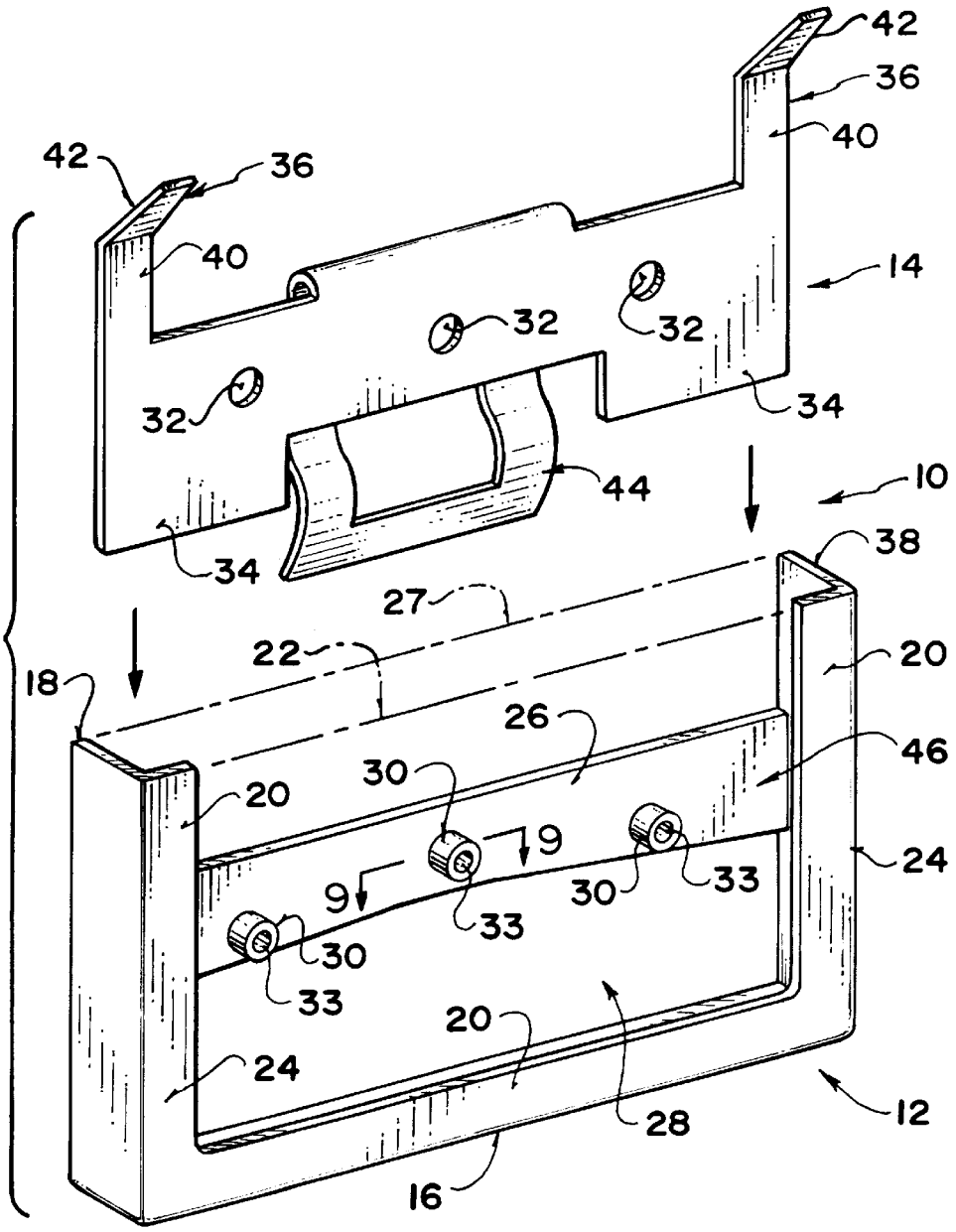
FIG. 1 is an isometric view of a housing and an insert of the card carrying case shown before they are assembled.
Figure 2:
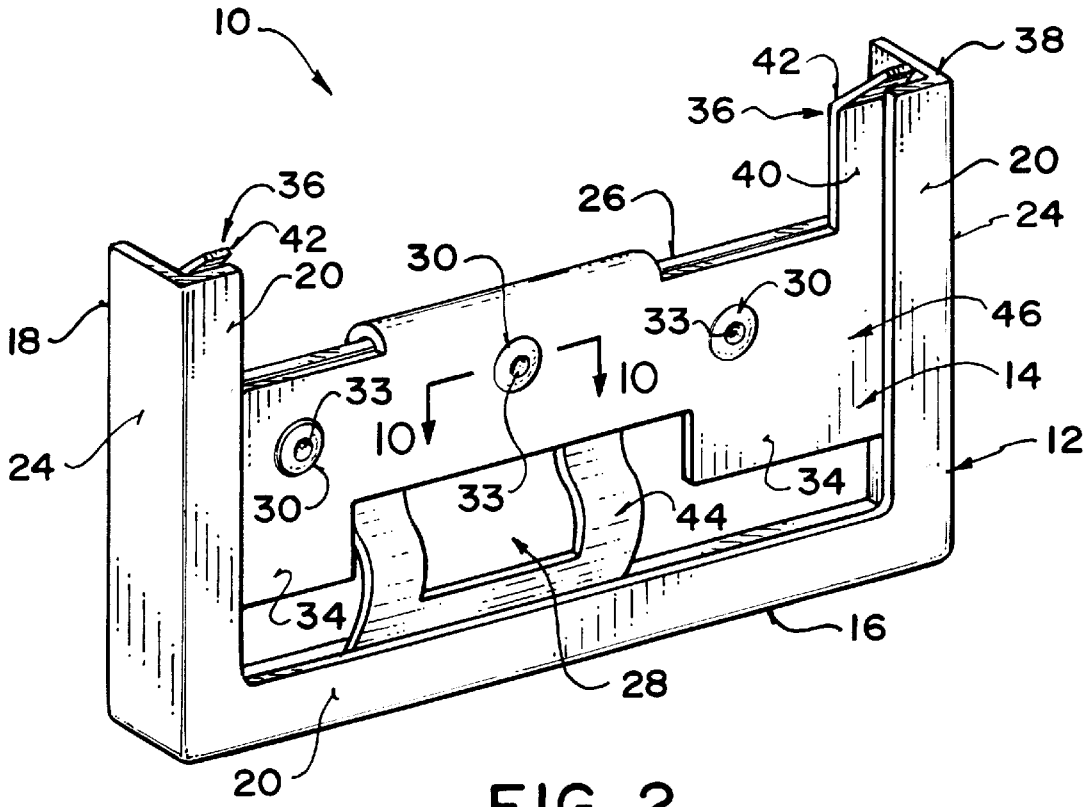
FIG. 2 is an isometric view of the housing and the insert of the card carrying case as they appear when they are assembled.
Figure 9:
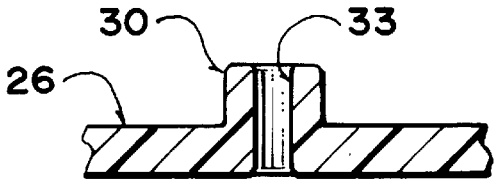
FIG. 9 is a cross sectional view along the line 9—9 of FIG. 1 showing a fastener before it has been expanded.

Referring to the accompanying drawings, there is illustrated a card carrying case indicated generally by the number 10 and being assembled from two components. The components include a housing 12 and an insert 14 for insertion into the housing when the case 10 is assembled.

The housing 12 is U-shaped and includes a bottom member 16 having an edge portion 18 and a flange 20 extending upward from the edge portion along a front face 22 of the case for retaining the cards within the housing 12. The edge portion 18 and the flange 20 of the bottom member 16 form an L-shaped profile. Two side members 24 are also included in the housing 12. Each side member 24 has an edge portion 18 and a flange 20 extending inward from the edge portion along the front face 22 of the case for retaining the cards within the housing 12. The edge portion 18 and the flange 20 of the side members 24 also form an L-shaped profile.

A supporting member 26 extends across a rear face 27 of the housing from one side member 24 to the other for retaining the cards. The support member 26, the bottom member 16 and the two side members 24 define a rear opening 28 for inserting the cards into the case. Cylindrical protrusions 30 for retaining the insert 14 within the housing 12 are mounted on the support member 26. The protrusions 30 are for co-operating with respective apertures 32 in the insert 14. The protrusions 30 are inserted through the respective apertures 32 such that there is little clearance between the two. A bore 33 extends axially through each protrusion 30.

Figure 10:
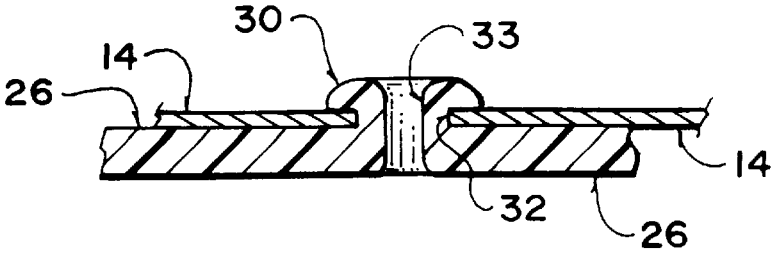
FIG. 10 is a cross sectional view along the line 10—10 of FIG. 2 showing a fastener after it has been expanded.
Figure 3:
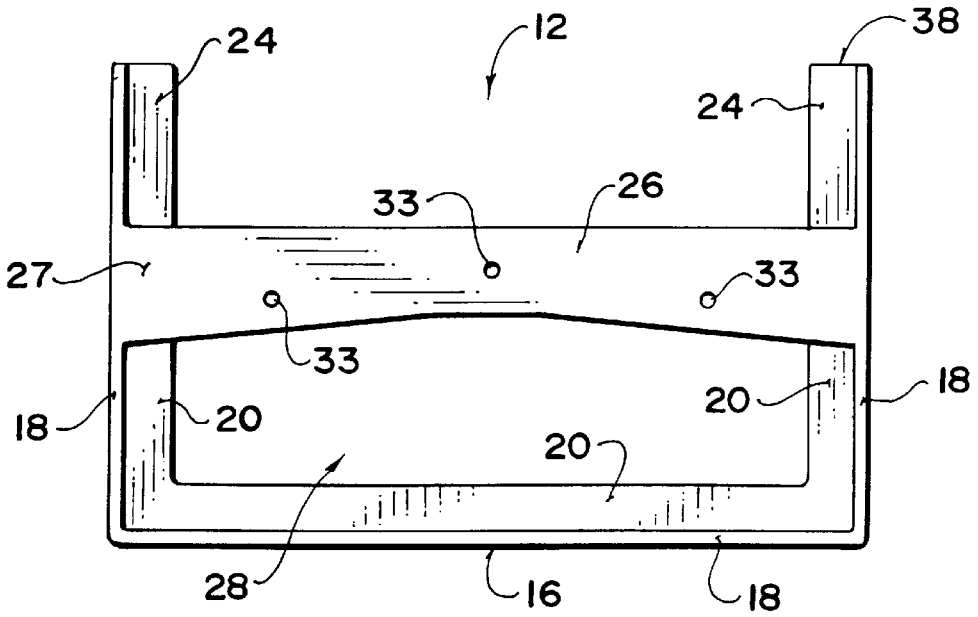
FIG. 3 is a rear elevational view of the housing.
Figure 4:
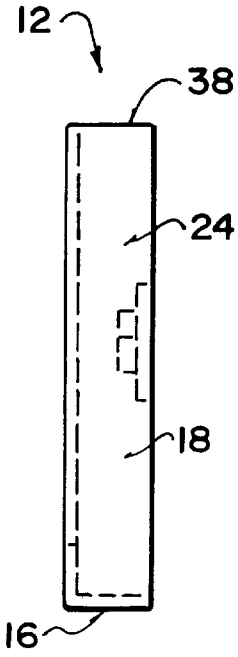
FIG. 4 is a side elevational view of the housing.
Figure 5:
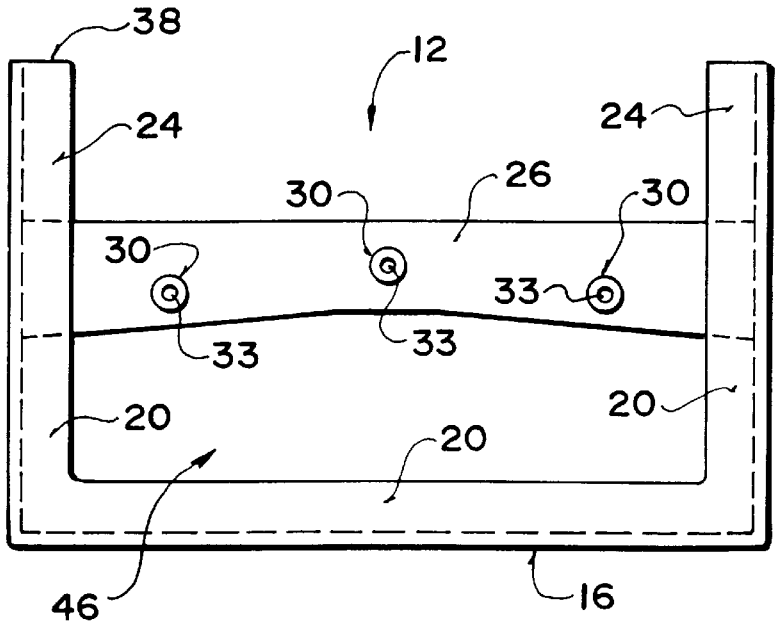
FIG. 5 is a front elevational view of the housing.
Figure 6:
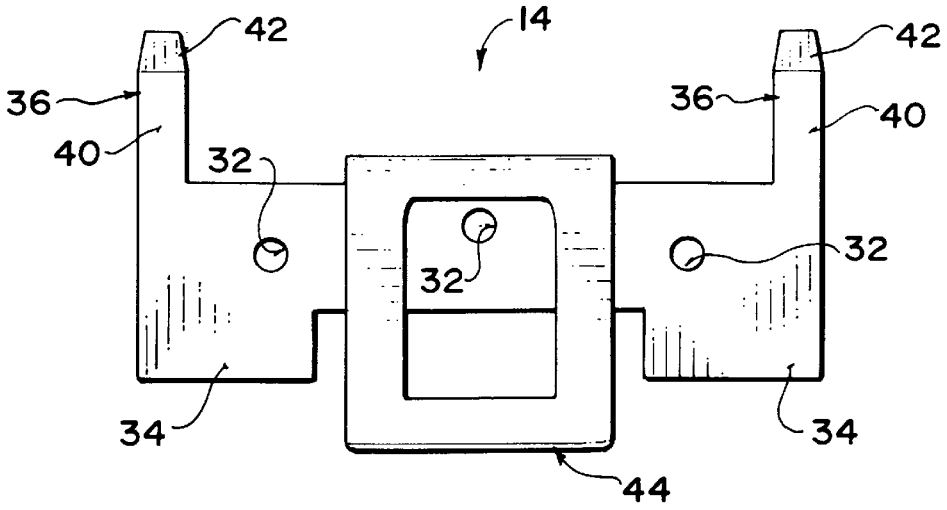
FIG. 6 is a rear elevational view of the insert.
Figure 7:
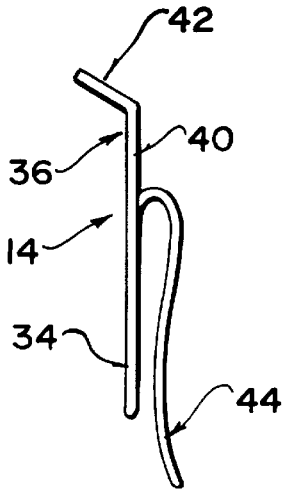
FIG. 7 is a side elevational view of the insert.
Figure 8:
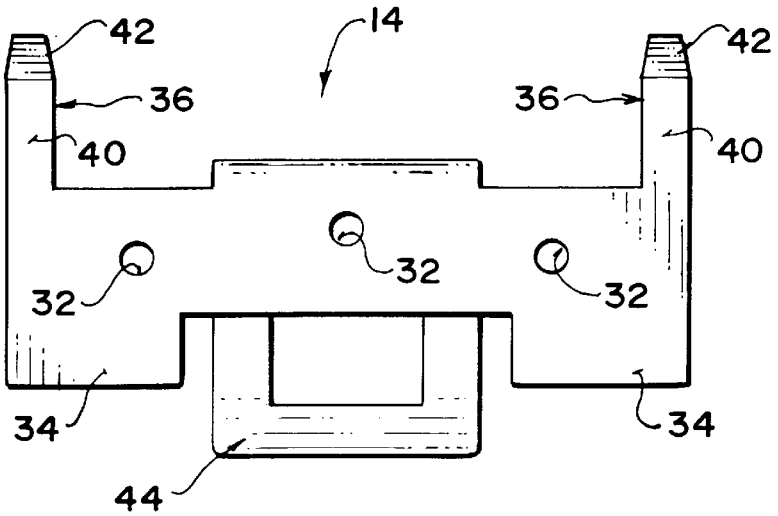
FIG. 8 is a front elevational view of the insert.

A tool is inserted into the bore 33 for expanding and flattening the protrusion such that the protrusion extends over an outer surface of the insert 14 and secures the insert in place as shown in FIG. 10. Once the protrusion has been flattened a screw or nail may be inserted through the bore 33 such that the case may be mounted to a supporting surface such as a wall.

The insert 14 includes a pair of leaf springs 34 which extend from the insert towards the bottom member 16 of the housing 12. The leaf springs 34 urge the cards towards the front face 22 to engage the flanges 20.

A pair of fingers 36 extend from the insert 14 towards a top end 38 of the housing. Each finger includes an upright portion 40 and an inclined portion 42 extending from the upright portion towards the front face 22 of the housing 12. The inclined portion 42 restricts the removal of the cards from the top end 38.

A clip 44 extends rearwards from the insert 14 for mounting the case to a belt for example, or setting the case upright on a table.

The case 10 is easily loaded with cards by inserting the cards through the rear opening 28. The cards require only slight flexing to get them into the case. Once the cards are in place the leaf springs 34 urge the cards towards the front face 22 of the case and make it difficult for the cards to be removed through the rear opening 28.

For dispensation of a single card a person may grip the card through a front opening 46 in the front face 22 of the case and pull the card towards the top end 38 of the housing. The inclined portion 42 of each finger 36 restricts the passage of more than one card. The cards to be dispensed are fully displayed by the front opening 46.

While one embodiment of the present invention has been described in the foregoing, it is to be understood that other embodiments are possible within the scope of the invention. The invention is to be considered limited solely by the scope of the appended claims.

What is claimed is:

1. A card carrying case comprising:

a U-shaped housing including a bottom member having an edge portion and a flange extending upward from the edge portion along a front face of the case for retaining the cards within the housing, and two side members wherein each side member has an edge portion and a flange extending inwards from the edge portion along the front face of the case for retaining the cards within the housing;

a support member extending across a rear face of the housing from one side member to the other side member for retaining the cards wherein the support member, the bottom member and the two side members define a rear opening for inserting the cards into the case;

at least one leaf spring extending from the support member towards the bottom member of the housing for urging the cards to engage the flanges of the bottom and two sides; and at least one finger extending from the support member towards a top end of the housing;

wherein each finger includes an upright portion and an inclined portion extending from the upright portion towards the front face of the housing for restricting the removal of the cards from the top end of the housing.

2. The card carrying case of claim 1 including a mounting clip on the support member.

3. The card carrying case of claim 1 including a mounting bracket on the support member for supporting the case on a wall.

4. The card carrying case of claim 1 including;

a main housing and an insert fastened within the main housing;

wherein the main housing includes;

the bottom member;

the two side members;

the support member; and at least one protrusion mounted on the support member;

and wherein the insert includes;

the at least one leaf spring;

the at least one finger; and an aperture in the insert for co-operating with each protrusion for fastening the insert to the housing.

5. The card carrying case of claim 4 wherein each protrusion comprises a raised cylindrical portion having a bore extending therethrough such that insertion of a tool into the bore will expand the raised cylindrical portion such that the cylindrical portion engages the aperture for further securing the insert on the main housing.

* * * * *